United States Patent [19]

McAllister

[11] 4,449,441

[45] May 22, 1984

[54] ELECTROMAGNETIC PROJECTILE LAUNCHER WITH MAGNETIC SPIN STABILIZATION

[75] Inventor: Dan R. McAllister, Sunnyvale, Calif.

[73] Assignee: Westinghouse Electric Corp., Pittsburgh, Pa.

[21] Appl. No.: 356,587

[22] Filed: Mar. 9, 1982

[51] Int. Cl.[3] ..... F41F 1/02

[52] U.S. Cl. ..... 89/8; 124/3

[58] Field of Search ..... 89/8; 124/3; 310/10

[56] References Cited

U.S. PATENT DOCUMENTS 1,370,200 3/1921 Fauchon-Villeplee ..... 89/8

FOREIGN PATENT DOCUMENTS 448496 6/1936 United Kingdom ..... 89/8

OTHER PUBLICATIONS

Proceedings of Impact Fusion Workshop (7/79) LA-8000-C, Electromagnetic Accelerator Concepts, Kolm, pp. 206, 212-213.

*Primary Examiner*—Sal Cangialosi

*Attorney, Agent, or Firm*—R. P. Lenart

[57] ABSTRACT

An electromagnetic projectile launcher is provided with a magnetic field in the path of the projectile. This field induces currents in conductors within the projectile or interacts with a magnetic projectile to produce a torque which imparts spin stabilization to the projectile. Arcuate conductive rails are brought together to form a cylindrical bore to accommodate the cylindrical projectile necessary for spin stabilization.

11 Claims, 6 Drawing Figures

ELECTROMAGNETIC PROJECTILE LAUNCHER WITH MAGNETIC SPIN STABILIZATION

BACKGROUND AND SUMMARY OF THE INVENTION

This invention relates to electromagnetic projectile launchers and more particularly to such launchers employing magnetic fields for spin stabilization of projectiles.

Electromagnetic projectile launchers are known which comprise a pair of conductive rails, a sliding conductive armature between the rails, a source of high current, and means for commutating this current into the rails and into the armature. This places an electromagnetic force on the armature which propels it along the conductive rails.

Present electromagnetic launchers are configured with parallel-sided rails and while this does have advantages in some cases, it essentially precludes imparting rotation to a projectile for spin stabilization. Therefore parallel-sided rail launchers utilize alternate stabilization means such as fins attached to the projectile. Electromagnetic launchers have been proposed that have skewed conductive rails to cause spin stabilization of the projectile where the pushing armature sabot was made to lockstep with the rails by use of notched armatures fitted between multiple rails of the launcher. While multiple skewed rails will impart spin, they have a reduction in force inversely proportional to the number of rails and they introduce additional sliding surface friction resulting in a net reduction in accelerating force for a given amount of available accelerating current. In addition, slotted coaxial elecromagnetic launchers have been proposed which eliminate the reduction in force for a given current but appear to introduce manufacturing complexities and, as with the skewed conductor launcher, require the attachment of the projectile to the armature sabot.

Electromagnetic launchers constructed in accordance with the present invention retain the basic simplicity of the parallel-sided rail launcher by introducing the spin stabilization of a projectile in a muzzle section having a magnetic flux field. To accomplish magnetic spin stabilization of the projectile, the bore of the launcher is made round to accommodate a round projectile as needed for spin stabilization. A launcher in accordance with this invention includes a pair of arcuate conductive rails which are brought together to form a cylindrical bore between the rails, a source of high current, means for commutating the current to the rails, means for conducting the current between the rails and for propelling a cylindrical projectile along the bore, means for generating a magnetic flux field through which the projectile passes during a launch, and means for imparting spin to the projectile in response to the passing of the projectile through the magnetic field.

DESCRIPTION OF THE PREFERRED EMBODIMENT

Figure 1:
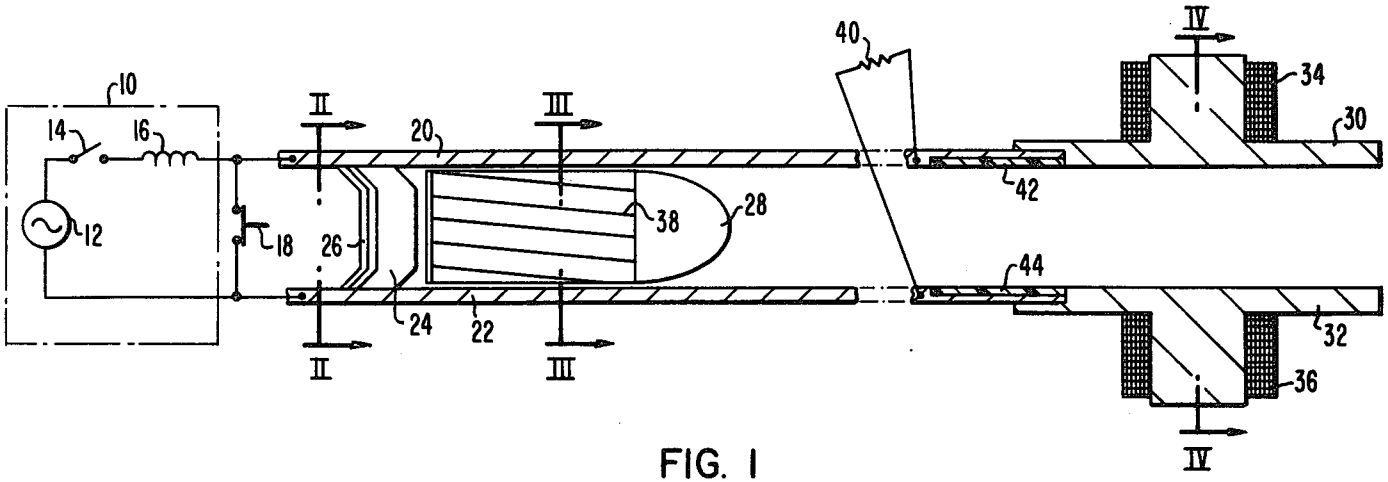
FIG. 1 is a schematic representation of an electromagnetic launcher in accordance with one embodiment of the present invention.

Referring to the drawings, FIG. 1 illustrates an electromagnetic launcher employing magnetic spin stabilization in accordance with one embodiment of this invention. Power supply 10 comprises the series connection of generator 12, switch 14 and inductor 16 and serves as a high current source for the launcher. Circuit breaker 18 serves as a means for commutating the high current of power supply 10 into conductive launcher rails 20 and 22. An armature comprising insulating sabot 24 and conductive element 26 is slidably disposed between rails 20 and 22 and provides means for conducting current between rails 20 and 22 and for propelling projectile 28 along the bore between rails 20 and 22 in response to current flowing in the rails and through the armature. In another embodiment, an arc may be used in place of the armature. Means for providing a magnetic flux field through which projectile 28 must pass includes magnetic pole elements 30 and 32 located adjacent the muzzle end of rails 20 and 22. In this embodiment, pole pieces 30 and 32 are components of electromagnets which are energized by the passage of current through coils 34 and 36, respectively.

Projectile 28 is of a generally cylindrical shape and includes conductive elements 38 embedded near the surface of the projectile and skewed with respect to the axis of the projectile. These conductors are connected to each other to allow an induced current flow when the projectile passes through the flux field created by pole pieces 30 and 32 and are skewed with respect to the axis of projectile 28. A magnetic field associated with current induced in these conductors interacts with the magnetic field between pole pieces 30 and 32 to create a tangential force which imparts the desired spin to the projectile. Additional components of the launcher include muzzle resistor 40 which is electrically connected to the muzzle end of the rails and dissipates energy in the system following a launch, and graded insulating inserts 42 and 44 which are disposed along the inner surface of conductive rails 20 and 22 near the muzzle end and ensure that the arc created as the armature passes the muzzle end of rails 20 and 22 is extinguished.

Figure 2A:
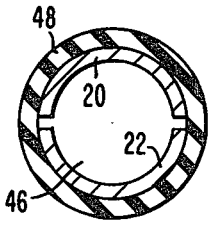
FIGS. 2A and 2B are alternative cross sections of the launcher of FIG. 1 taken along line II—II.
Figure 2B:
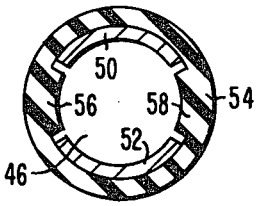

FIGS. 2A and 2B are alternative cross sections of the launcher of FIG. 1 taken along line II—II. FIG. 2A shows arcuate conductive rails 20 and 22 brought together to form cylindrical bore 46 and held in place by insulating support structure 48. When higher driving or commutating voltages are used, arcing may occur between conductors 20 and 22. In order to eliminate this undesirable arcing, FIG. 2B shows arcuate conductors 50 and 52 having a smaller angular embrace. In this arrangement, insulating support structure 54 includes protrusions 56 and 58 which separate conductive rails 50 and 52 and provide a portion of the cylindrical bore for the traversing projectile.

Figure 3A:
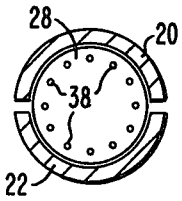
FIGS. 3A and 3B are alternative cross sections of the launcher of FIG. 1 taken along line III—III.
Figure 3B:
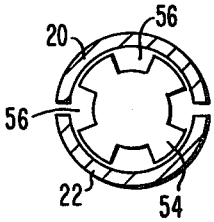

FIGS. 3A and 3B show alternative cross sections of the launcher of FIG. 1 taken along line III—III. In FIG. 3A, projectile 28 is shown between conductive rails 20 and 22. Conductors 38 are buried near the surface of projectile 28, arranged generally longitudinally, and connected together so that current may flow between conductors 38 as projectile 28 passes through the magnetic field at the muzzle end of the launcher. FIG. 3B shows an alternative projectile 54 located between conductive rails 20 and 22. In this embodiment, projectile 54 is constructed of magnetic material and includes notches 56 along the surface of the projectile. These notches 56 run longitudinally along the surface of projectile 54 and are skewed with respect to the axis of projectile 54. Alternatively, the notches may be embedded below the surface of the projectile 54. The notched projectile surface, or subsurface, will cause a varying flux field as the projectile traverses the flux field at the muzzle end of the launcher. Therefore a resultant reluctance torque will be imparted to the projectile. The amount of skew in embedded conductors 38 or notches 56 is dependent upon the amount of tangential force needed to impart the desired spin to the projectile for the amount of field flux being utilized.

Figure 4:
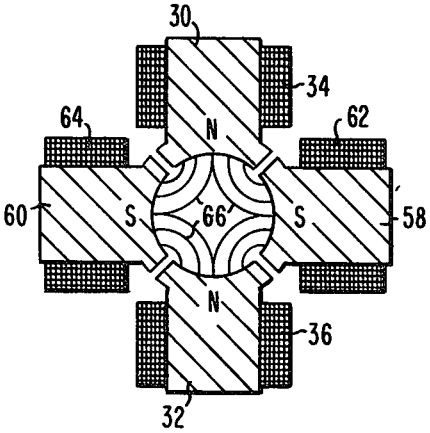
FIG. 4 is a cross section of the launcher of FIG. 1 taken along line IV—IV.

FIG. 4 shows one embodiment of a means for generating a magnetic flux field in the vicinity of the muzzle end of the launcher in accordance with this invention. FIG. 4 is a cross section of the launcher of FIG. 1 taken along line IV—IV. The poles 30, 32, 58 and 60 will generate magnetic field 66 when coils 34, 36, 62 and 64 are energized, respectively. Although a 4-pole system is shown, the flux field may be produced by a variety of numbers of poles depending upon the physical configuration to be accommodated, for example the diameter of the projectile, the skew of the conductors or notches in the projectile, the muzzle velocity, etc. In addition, a field flux can be introduced by appropriately configured permanent magnets as well as electromagnets. If electromagnets are used, it would be possible to select the desired amount of spin stabilization by varying the field coil current, thereby varying the flux field intensity for a given projectile configuration and a given projectile velocity.

Therefore, it can be seen that electromagnetic launchers in accordance with this invention provide for a relatively simple configuration, the introduction of spin stabilization and the ability to easily control the amount of spin stabilization. In addition, augmenting projectile launching rails can be added to the launcher and the necessity of attaching the projectile to the armature as found in previous launchers has been eliminated. The spin stabilization flux field also provides a degree of shielding for any spurious magnetic or electric fields caused by commutation of the armature current into the muzzle arc resistor.

What is claimed is:

1. A parallel rail electromagnetic projectile launcher comprising:

a first conductive rail having an arcuate surface;

a second conductive rail having an arcuate surface and being disposed parallel to said first conductive rail, to form a cylindrical bore between said rails, wherein the arcuate surfaces of said rails define a portion of the perimeter of said bore;

a source of high current;

means for commutating said current to said rails;

means for conducting current between said rails and for propelling a cylindrical projectile along said bore;

means for generating a magnetic flux field through which said projectile passes during a launch, wherein said magnetic flux field is distinct from electromagnetic fields produced by current flowing through said rails which are used to propel said projectile; and means for imparting electromagnetically induced spin to said projectile in response to the passing of said projectile through said magnetic flux field.

2. An electromagnetic projectile launcher as recited in claim 1, wherein said means for imparting spin to said projectile comprises:

a plurality of conductors arranged generally longitudinally within said projectile, said conductors being electrically connected to each other and skewed with respect to the axis of said projectile.

3. An electromagnetic projectile launcher as recited in claim 1, wherein said means for imparting spin to said projectile comprises:

a cylindrical magnetic segment of said projectile;

said magnetic segment being notched longitudinally and said notches being skewed with respect to the axis of said projectile.

4. An electromagnetic projectile launcher as recited in claim 1, wherein said means for generating a magnetic flux field comprises:

a plurality of magnets.

5. An electromagnetic launcher as recited in claim 4, wherein similar magnetic poles are disposed on diametrically opposite sides of said bore.

6. An electromagnetic launcher as recited in claim 4, wherein said magnets are permanent magnets.

7. An electromagnetic launcher as recited in claim 4, wherein said magnets are electromagnets.

8. An electromagnetic launcher as recited in claim 7, further comprising:

means for energizing said electromagnets.

9. An electromagnetic launcher as recited in claim 1, further comprising:

insulation disposed between said rails, said insulation including protrusions which form a portion of the perimeter of said bore.

10. An electromagnetic launcher as recited in claim 1, further comprising:

a graded insulation insert disposed along the inner surface of each of said rails at the muzzle end of said rails.

11. An electromagnetic launcher as recited in claim 1, further comprising:

a muzzle arc resistor electrically connected to the muzzle end of said rails.

* * * * *